US005102208A

United States Patent [19]

Joynes et al.

[11] Patent Number: 5,102,208

[45] Date of Patent: Apr. 7, 1992

[54] LAUNDRY HAMPER SORTER

[76] Inventors: Charles E. Joynes; Lisa R. Joynes, both of 11 Cooks Hill Lane, Somerset, Bermuda, MA05

[21] Appl. No.: 590,952

[22] Filed: Oct. 1, 1990

[51] Int. Cl.[5] ..... A47B 45/00

[52] U.S. Cl. ..... 312/205; 248/95; 248/99

[58] Field of Search ..... 248/95, 97, 99, 101; 312/205, 280, 282

[56] References Cited

U.S. PATENT DOCUMENTS 2,141,468 12/1938 Hamaker ..... 312/205 X
2,695,150 11/1954 Criswell ..... 248/101
2,899,161 8/1959 Bayard ..... 248/101
3,744,081 7/1973 Miller ..... 248/101 X
3,995,924 12/1976 Jones .

FOREIGN PATENT DOCUMENTS 2374868 8/1978 France ..... 312/205
801308 9/1958 United Kingdom ..... 248/99

*Primary Examiner*—Joseph Falk

[57] ABSTRACT

A clothes container having two external clothes bags at its opposite ends. Soiled clothing of different colors or materials can be selectively placed in the container and the two bags to sort out the clothes prior to placement in a washing machine. The bags augment the capacity of the container. When desired the bags can be adjusted to closed positions in near proximity to the container end walls.

5 Claims, 1 Drawing Sheet

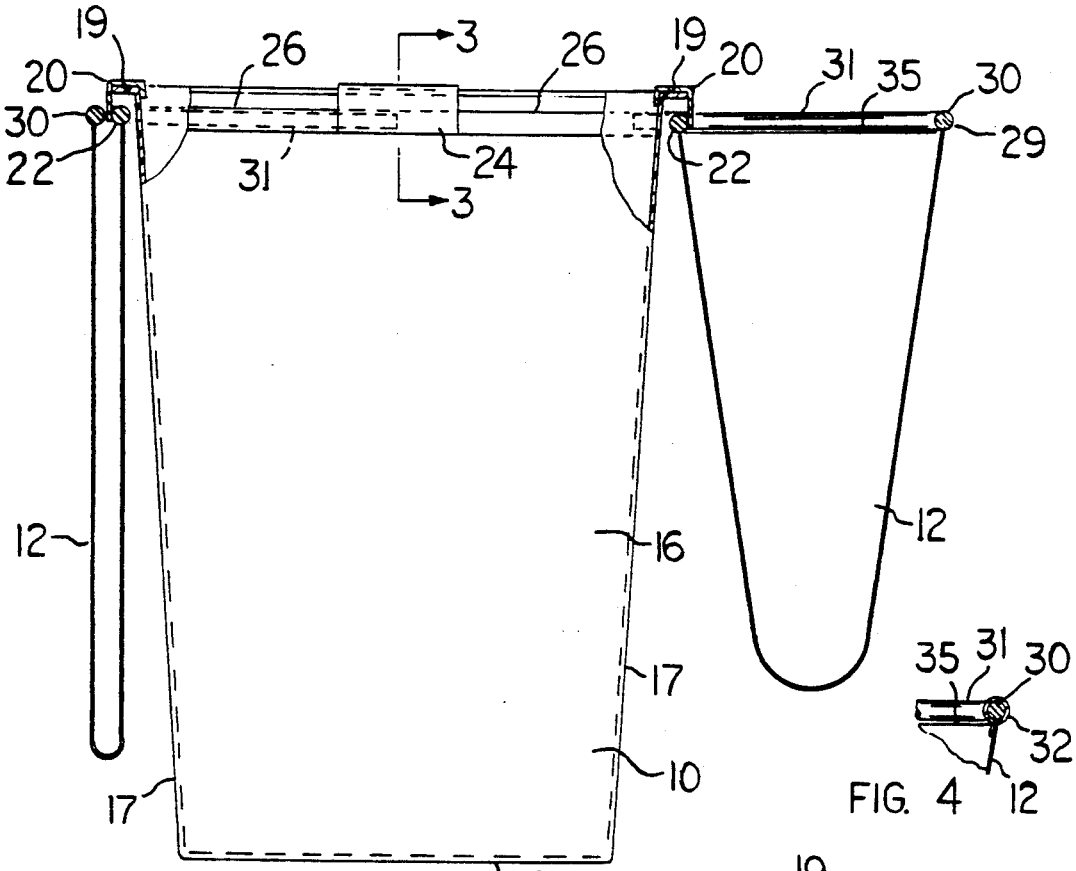
FIG. 1
FIG. 4
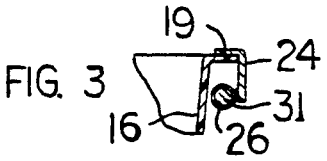
FIG. 3
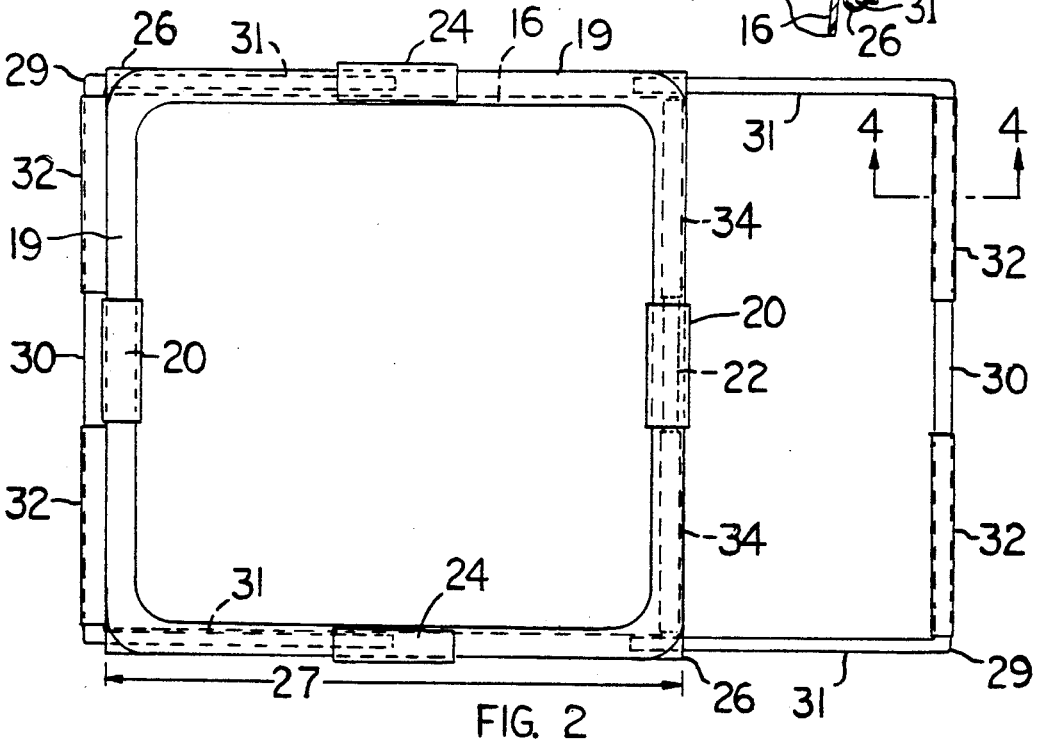
FIG. 2

LAUNDRY HAMPER SORTER

BACKGROUND AND SUMMARY OF THE INVENTION

This invention relates to a device for storing and sorting soiled clothes prior to placement of the clothes in a washing machine. In some respects the device of this invention is similar to a clothes sorting mechanism shown in U.S. Pat. No. 3,995,924 to C. B. Jones.

U.S. Pat. No. 3,995,924 shows a clothes hamper having a central upstanding post therein. Hooks are carried on the post and on the side walls of the hamper for suspending four bags within the hamper. The inventor indicates that the bags can be of different colors for indicating the type of clothing to be placed in each bag. For example, a white bag would be used to receive sheets, pillow cases and other white clothes; a light yellow bag could be used to receive light-colored clothes; and a navy blue bag could be used to receive dark clothes. Each bag is removable from the hamper for transferring the clothes to a washing machine.

The present invention contemplates an arrangement wherein two clothes-receiving bags are supported outside the main clothes container, i.e. adjacent to opposite end walls of the container. Each bag is suspended from a U-shaped frame that has two parallel arms adapted to slide within linear guides carried on the side walls of the container. Each U-shaped frame can be moved away from the container to open the associated bag. Each U-shaped frame can be moved toward the container to close the associated bag. The two bags can be opened and closed independently.

The add-on bags augment the clothes-storing capacity of the main container without at the same time unduly increasing the overall size of the container system. Three separate clothes-reception compartments are provided by the container and the two associated bags. Clothes will be inserted into the three compartments according to their color and/or type of material. The apparatus facilitates the separation of clothing prior to collection of the clothes for placement in a washing machine.

THE DRAWINGS

FIG. 1 is a side elevational view of an apparatus embodying the invention; parts of the apparatus are shown in section.

FIG. 2 is a top plan view of the FIG. 1 apparatus.

FIG. 3 a fragmentary sectional view taken on line 3—3 in FIG. 1.

FIG. 4 fragmentary sectional view taken on line 4—4 in FIG. 2.

DESCRIPTION OF A PREFERRED EMBODIMENT OF THE INVENTION

FIG. 1 shows a main open-topped container 10 adapted to receive soiled clothes. Two additional clothes-reception bags 12 are suspended from a frame structure located outside the main container. The bags can assume open or closed positions. In FIG. 1 the rightmost bag 12 is shown in an open condition; the leftmost bag 12 is shown in a closed condition. Container 10 is preferably formed of a deformable plastic or rubber material (to facilitate installation of the bag-suspension frame structure). Each bag 12 can be formed of a flexible open mesh (net) material or a cloth material. Each bag is a four-sided bag that tapers in the downward direction. The taper is for the purpose of minimizing the lateral projection of the bag when it is in the closed position.

Container 10 comprises a bottom wall 14, two upstanding opposed side walls 16, and two upstanding end walls 17. Walls 16 and 17 terminate in a peripheral rim wall 19. The space circumscribed by walls 16 and 17 is open at the top for placement of soiled clothing into the container.

The bag-suspension frame structure comprises two clips 20 adapted to hook over rim wall 19 at points midway along the length of each end wall 17. A horizontal cross bar 22 is welded or otherwise attached to each clip 20.

The bag-suspension frame structure further comprises two additional clips 24 adapted to hook over rim wall 19 at points midway along the length of each side wall 16. A horizontal guide tube 26 is welded or otherwise affixed to each clip 24. Dimensional line 27 in FIG. 2 denotes the length of each guide tube. Cross bars 22 may be welded to tubes 26 to rigidify the frame structure. The two cross bars 22 and the two tubes 26 collectively form an annular support means for two U-shaped frames 29.

Each bag 12 is suspended partly from the associated cross bar 22 and partly from an associated U-shaped frame 29; the U-shape of the frame is the frame configuration taken in the top plan direction (FIG. 2). Each frame 29 comprises an elongated web portion 30 and two parallel arm portions 31. Each arm portion 31 is slidably arranged within one of the linear guides, so that frame 29 can be moved toward or away from container 10. Frame 29 is preferably formed out of steel or aluminum rod having a circular cross section.

Each bag 12 has two fabric loops 32 extending around web element 30. Two additional fabric loops 34 extend from the bag around cross bar 22. The portions of the bag below arms 31 are left unconnected to frame 29 in order to avoid interference between the bag and frame 29 when the frame is moved into close proximity to cross bar 22, as shown in FIG. 1 with the leftmost bag. Numeral 35 in FIGS. 1 and 4 indicates the upper edge portion of the bag below each arm portion 31.

The bag-suspension means is preferably designed so that it can be installed onto a pre-existing container and/or removed from a container. The two bags augment the clothes storing capacity of the container and provide a clothes-sorting capability that is not available when the container is used alone (without the bags). Either bag can be opened or closed independently of the other bag. When the bags are closed they are relatively inconspicuous and take up relatively small floor space. The bags may be retained in closed positions by frictional forces between arms 31 and guides 26.

The drawings shown one particular form that the invention can take. It will be appreciated that the invention can be practiced in other forms.

We claim:

1. A clothes sorting and clothes storage device, comprising an upwardly open container having two spaced side walls and two spaced end walls terminating in a peripheral rim; an annular frame support means encircling said container, said annular support means comprising two linear guides extending horizontally along the container side walls a slight distance below the rim, and two cross bars connecting the ends of said guides in near proximity to the container side walls; clip means carried by said annular support means to hook over the peripheral rim and thereby orient said annular support means on the container; two U-shaped frames, each frame including a web element and two parallel arms extending right angularly from said web element into respective ones of the linear guides; said arms being slidable on said guides whereby each associated web element can be moved toward or away from the associated cross bar; and a flexible bag suspended from each cross bar and the associated web element; each said web element being movable toward the associated cross bar to close the associated bag; each web element being movable away from the associated cross bar to open the associated bag.

2. The clothes sorting and clothes storage device of claim 1, wherein each U-shaped frame is a U-shaped metal rod having a circular cross section.

3. The clothes sorting and clothes storage device of claim 2, wherein each linear guide is a horizontal tube.

4. The clothes sorting and clothes storage device of claim 1, wherein said clip means comprises four separate clips; two of said clips being attached to the linear guides at central points therealong; two of said clips being attached to the cross bars at central points therealong.

5. The clothes sorting and clothes storage device of claim 1, wherein said clip means has detachable engagement on the peripheral rim of the container, whereby said annular support means can be installed on the container or removed from the container by manipulation of the clip means onto or off of the peripheral rim.

* * * * *